United States Patent [19]

Kozacka et al.

[11] 4,240,058

[45] Dec. 16, 1980

[54] FUSE TERMINAL CONNECTOR FOR ONE OR MORE ELECTRIC FUSES

[75] Inventors: Frederick J. Kozacka, South Hampton; Richard A. Belcher, Hampton Falls, both of N.H.

[73] Assignee: Gould Inc., Rolling Meadows, Ill.

[21] Appl. No.: 68,238

[22] Filed: Aug. 20, 1979

[51] Int. Cl.[3] ..... H01F 7/08

[52] U.S. Cl. ..... 337/231; 337/252

[58] Field of Search ..... 337/159, 187, 190, 214, 337/215, 229, 231, 248, 251, 252

[56] References Cited

U.S. PATENT DOCUMENTS

| | | | |
|---|---|---|---|
| 3,413,585 | 11/1968 | Kozacka | 337/158 X |
| 3,849,754 | 11/1974 | Blewitt et al. | 337/231 |
| 3,863,187 | 1/1975 | Mahieu et al. | 337/159 X |
| 3,967,228 | 6/1976 | Koch et al. | 337/248 |

*Primary Examiner*—George Harris

*Attorney, Agent, or Firm*—Erwin Salzer

[57] ABSTRACT

An electric fuse including blade contacts projecting through the terminal caps into the casing. The axially inner ends of the blade contacts are conductively connected by electroconductive elements to the axially outer ends of the fusible element. The electroconductive elements each comprise a first planar arm conductively affixed to one end of the fusible element, a second planar arm arranged parallel to and spaced from said first planar arm and conductively affixed to one end of the blade contact, and tie means integral with said first and said second arm conductively connecting the axially outer end of said first arm to the axially inner end of said second arm.

5 Claims, 2 Drawing Figures

FUSE TERMINAL CONNECTOR FOR ONE OR MORE ELECTRIC FUSES

BACKGROUND OF THE INVENTION

In blade contact fuses the fusible elements thereof are conductively connected on both ends thereof to the blade contacts. These fuse structures are relatively rigid, or unflexible. It is, therefore, one object of this invention to provide electric fuses of the aforementioned kind, the blade-contact-fusible-element unit of which has a much higher flexibility than the aforementioned prior art fuses.

In prior art blade contact fuses having a plurality of fusible elements the use of the pulverulent arc-quenching filler was a very poor one, resulting in merger of the fulgurites and unsatisfactory spacings thereof, i.e. spacings that were too small. Such fuses are disclosed in many prior art patents such as, for instance, U.S. Pat. No. 4,053,860; Oct. 11, 1977 to Frederick J. Kozacka et al, for ELECTRIC FUSES. It is, therefore, still another object of the present invention to provide electric blade contact fuses wherein the cooling and deionizing action of the arc-quenching filler is greatly improved.

Another object of the invention is to improve the fuses disclosed in U.S. Pat. No. 3,413,585 to F. J. Kozacka; 11/26/68 for ELECTRIC CARTRIDGE FUSE HAVING OFF CENTER FUSIBLE ELEMENTS.

In fuses of the aforementioned kind it was not possible, heretofore, to arrange a single, U-shaped fusible element along the axis of the tubing of the fuses if the blade contacts were properly positioned along a diameter of the end surfaces of the terminal caps. It is, therefore, another object of this invention to provide electric fuses that are not subject to this limitation. Other objects and advantages of this invention will become apparent as this specification proceeds.

SUMMARY OF THE INVENTION

In fuses according to the present invention a pair of electroconductive elements of sheet metal is interposed between the axially inner ends of the blade contacts, and the axially outer ends of the fusible element. Each of these electroconductive elements has first substantially planar arms that are affixed to each end of the fusible element, second substantially planar arms each affixed to one of the ends of the blade contacts, and each of said electroconductive elements include tie means conductively connecting the axially outer ends of each said first arms to the axially inner ends of each said second arms.

The first arm, the second arm and the tie means of each electroconductive element may be formed by a single strip of metal that is bent twice about turns of 90 degrees.

DESCRIPTION OF PREFERRED EMBODIMENT

Figure 1:
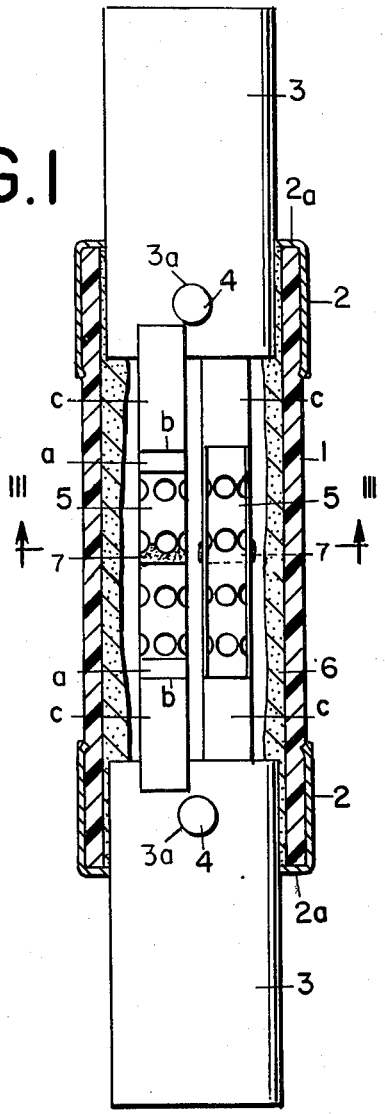
FIG. 1 illustrates in a longitudinal section a fuse embodying the present invention.
Figure 2:
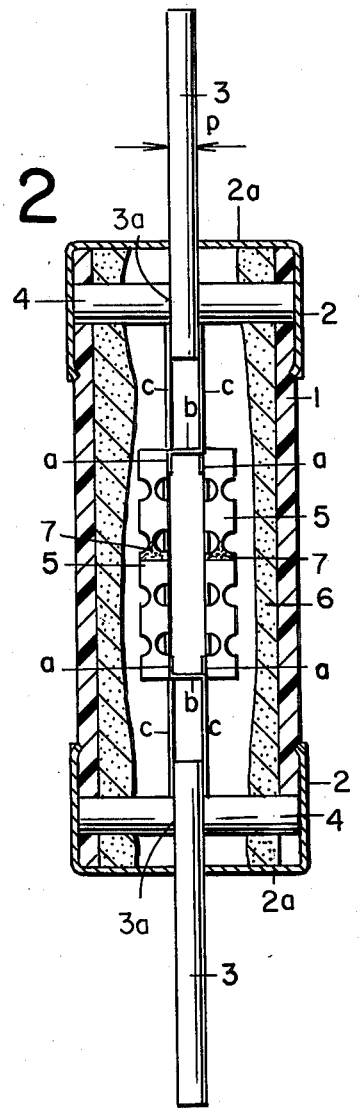
FIG. 2 shows the same fuse as FIG. 1 taken along a plane at 90 degrees to the plane at which FIG. 1 was taken.
Figure 3:
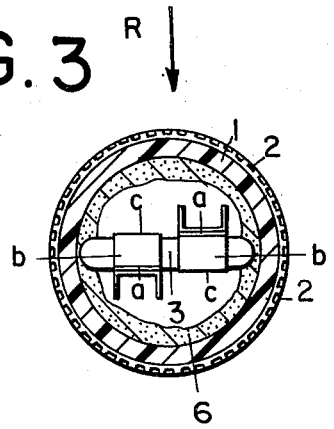
FIG. 3 is a section along III—III of FIG. 1 seen in the direction of the arrow R of FIG. 3.

Referring now to the drawing, numeral 1 has been applied to indicate a tubular casing of electric insulating material, such as a laminate of glass-cloth and melamine. Casing I is closed on both ends by terminal caps 2 and blade contacts 3 project through the end surfaces 2*a* of caps 2. The axially inner end of caps 2 may be knurled into casing 1. Each blade contact 3 is provided with a bore 3*a* through which a pin 4 projects. Pins 4 are preferably of steel and tubular, slotted in a direction longitudinally thereof, and a pair of screw-threaded nails may be pushed in each of their axial ends supported by casing 1 to expand these ends and firmly connect them with casing 1. Blade contacts 3 are thus supported at two points, namely where they project through the end surfaces 2*a* of caps 2 and where they are held in position by pins 4. Reference numeral 5 has been applied to indicate a pair of channel-shaped fusible elements of silver, or of copper. Each fusible element 5 comprises a web portion and two flange portions. The web portions of fusible elements 5 are arranged in parallel, spaced planes having a spacing which is about equal to the thickness p of blade contacts 3. Each fusible element is conductively connected to blade contacts 3 by intermediate conductive elements a,b,c. Portions a of each conductive element is relatively short and conductively connected to the ends of fusible elements 5, portions c of each conductive element are relatively long and conductively connected to the ends of blade contacts 3, and the intermediate portions b of each conductive element are much shorter than portions c and conductively interconnect the axially inner portions of a with the axially outer portions of b. The conductive connections between blade contacts 3, arms c, and the conductive connections between fusible elements 5 and arms a may, for instance, be effected by spot welding.

It will be apparent from the above that the fusible elements 5 are arranged in parallel spaced planes and conductively connected to different sides of the blade contacts 3, which greatly increases the mass of quartz sand, or other pulverulent arc-quenching filler 6 which separates fusible elements 5.

In the drawing numeral 7 has been applied to indicate an M-effect causing overlay.

The longer arm c relative to arm b, the greater the flexibility of the fusible element and blade contact assembly, or structure. Therefore, the length of arm c should be a multiple of the length of arm b.

The present structure allows a considerable shortening of blade contacts 3 and saving of copper in comparison to the fuse structure shown in U.S. Pat. No. 3,413,585; Nov. 26, 1968 to F. J. Kozacka for ELECTRIC FUSE HAVING OFF CENTER FUSIBLE ELEMENT, because the intermediate electroconductive elements a,b,c require a much smaller volume of copper than the blade contacts 3, and the voltage drop along intermediate electroconductive elements a,b,c is so small as not to call for the long blade contacts of U.S. Pat. No. 3,413,585 to limit the voltage drop to acceptable proportions. It will be also apparent that the fusible elements 5 of the present invention could be arranged off-center, as shown in U.S. Pat. No. 3,413,585.

In the drawings, the pulverulent arc-quenching filler 6 has only been shown along the interface between casing 1 and the body of filler 6. This has been done for reasons of greater clarity. Actually arc-quenching filler 6 fills also the space within casing 1 not occupied by any other parts.

It will be understood that this invention is not limited to fuses having channel-shaped fusible elements, but is applicable to fuses with fusible elements having a different geometrical configuration such as, for instance, whose fusible elements are substantially planar, or fuses whose fusible elements are substantially L-shaped.

We claim as our invention:

1. An electric fuse comprising a tubular casing of electric insulating material, an arc-quenching filler inside said casing, a fusible element inside said arc-quenching filler, a pair of terminal caps closing said casing to retain said arc-quenching filler in said casing, a pair of blade contacts projecting through the end surfaces of said pair of caps from the outside of said casing to the inside thereof, said pair of blade contacts each having a perforation situated inside said casing and a pair of support pins each projecting through said casing into said perforation in one of said pair of blade contacts wherein the novel feature comprises a pair of intermediate electroconductive elements of sheet metal of which each has a first substantially planar arm conductively affixed to one end of said fusible element, of which each has a second substantially planar arm arranged in spaced relation from and parallel to said first arm conductively affixed to the axially inner ends of one said pair of blade contacts, each of said pair of intermediate electroconductive elements further including substantially planar tie means arranged in angular relation to and conductively connecting the axially outer end of each first arm to the axially inner end of each second arm.

2. An electric fuse as specified in claim 1 wherein the length of said first arm is less than the length of said second arm.

3. An electric fuse as specified in claim 1 wherein the length of said second arm is a multiple of the length of said first arm.

4. An electric fuse as specified in claim 1 including one pair of fusible elements and two pairs of intermediate electroconductive elements, said first arms of one pair of said two pairs of intermediate electroconductive elements being affixed to one pair of said two pairs of fusible elements, and said second arms of one pair of said two pairs of intermediate electroconductive elements being affixed to one side of said pair of blade contacts, said first arms of the other pair of said two pairs of intermediate electroconductive elements being affixed to the other of said two pairs of fusible elements and said second arms of the other of said two pairs of intermediate electroconductive elements being affixed to the other side of said pair of blade contacts.

5. An electric fuse as specified in claim 1 including one pair of channel-shaped fusible elements each including a web portion and flange portions, said web portion of each pair of fusible elements being arranged in parallel spaced planes and the flange portions thereof projecting in opposite directions from said web portions, said fuse further including two pairs of intermediate electroconductive elements, said first arms of one of said two pairs of intermediate electroconductive elements being affixed to the web portion of one pair of said two pairs of fusible elements, and said second arms of one pair of said two pairs of intermediate electroconductive elements being affixed to one side of said pair of blade contacts, said first arms of the other pair of said two pairs of intermediate electroconductive elements being affixed to the web portion of the other pair of said two pairs of fusible elements, and said second arms of said other pair of said two pairs of intermediate electroconductive elements being affixed to the other side of said pair of blade contacts.

* * * * *